US010939212B2

(12) United States Patent
French

(10) Patent No.: US 10,939,212 B2
(45) Date of Patent: Mar. 2, 2021

(54) ACOUSTIC TRANSDUCER AND MAGNETIZING CURRENT CONTROLLER

(71) Applicant: Harman International Industries, Incorporated, Stamford, CT (US)

(72) Inventor: John B. French, Port Carling (CA)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/673,268

(22) Filed: Nov. 4, 2019

(65) Prior Publication Data

US 2020/0068313 A1 Feb. 27, 2020

Related U.S. Application Data

(63) Continuation of application No. 15/714,142, filed on Sep. 25, 2017, now Pat. No. 10,469,950.

(51) Int. Cl.

| | |
|---|---|
| ***H04R 9/02*** | (2006.01) |
| ***H04R 9/06*** | (2006.01) |
| ***G10K 9/13*** | (2006.01) |

(52) U.S. Cl.

CPC ..... *H04R 9/025* (2013.01); *G10K 9/13* (2013.01); *H04R 9/06* (2013.01)

(58) Field of Classification Search

CPC ..... H04R 9/025; H04R 9/046; H04R 3/00; H04R 3/002; H04R 2209/021; H04R 2209/022; G10K 9/13

See application file for complete search history.

(56) References Cited

U.S. PATENT DOCUMENTS

| | | | | |
|---|---|---|---|---|
| 8,139,816 | B2 | 3/2012 | French et al. | |
| 9,241,213 | B2 | 1/2016 | French et al. | |
| 2005/0031140 | A1 | 2/2005 | Browning | |
| 2005/0134374 | A1* | 6/2005 | Hench | H03F 1/34 330/86 |
| 2007/0080745 | A1 | 4/2007 | French et al. | |
| 2014/0153770 | A1 | 6/2014 | French et al. | |
| 2015/0010198 | A1* | 1/2015 | French | H04R 9/00 381/414 |

FOREIGN PATENT DOCUMENTS

| | | | |
|---|---|---|---|
| JP | S5967796 | A | 4/1984 |

* cited by examiner

*Primary Examiner* — Sunita Joshi
(74) *Attorney, Agent, or Firm* — Brooks Kushman P.C.

(57) ABSTRACT

An acoustic transducer includes a controller configured to receive an input audio signal and to generate a first reference signal indicative of an envelope of the input audio signal. The controller is further configured to provide a stationary coil signal to a stationary coil of an acoustic transducer based on the first reference signal and to measure a current through the stationary coil after providing the stationary coil signal to the stationary coil. The controller is further configured to generate a first output indicative of the current through the stationary coil and to determine a magnetic flux in an air gap of magnetic material based on the first output. The controller is further configured to generate a voltage output for a moving coil that is inversely proportional to the magnetic flux in the air gap. The voltage output provides an undistorted output that corresponds to the input audio signal.

17 Claims, 6 Drawing Sheets

ACOUSTIC TRANSDUCER AND MAGNETIZING CURRENT CONTROLLER

CROSS-REFERENCE TO RELATED APPLICATIONS

This application is a continuation of U.S. application Ser. No. 15/714,142 filed Sep. 25, 2017, now U.S. Pat. No. 10,469,950 issued Nov. 5, 2019 the disclosure of which is hereby incorporated in its entirety by reference herein.

TECHNICAL FIELD

Aspects disclosed herein generally relate to an acoustic transducer arrangement and magnetizing current controller. This aspect and others will be discussed in more detail herein.

BACKGROUND

U.S. Pat. No. 8,139,816 to French et al. ("the '816 patent") provides acoustic drivers with stationary and moving coils. Time varying signals are applied to the moving and stationary coils to control the movement of a diaphragm, which produces audible sound. The time varying signals correspond to an input audio signal such that the sound corresponds to the input audio signal. Some of the described embodiments include multiple moving coils, multiple stationary coils or both. Some embodiments include feedback for adjusting one or more of the signals based on a characteristic of the acoustic driver.

U.S. Pat. No. 9,241,213 to French et al. ("the 213 patent") provides acoustic transducers with stationary and moving coils, and methods for operating the acoustic transducers. Time varying signals are applied to the moving and stationary coils to control the movement of a diaphragm, which produces sound. The time varying signal applied to the moving coil corresponds to at least a processed version of an input audio signal and is updated based on, at least, a version of the time varying signal applied to the stationary coil. Some embodiments include updating the processed version of the input audio signal in response to a magnetic flux value corresponding to the time-varying signal applied to the stationary coil. Some embodiments include updating the time-varying signal applied to the moving coil in response to a feedback signal.

SUMMARY

In at least one embodiment, an acoustic transducer arrangement comprising an audio input terminal to receive an input audio signal and an acoustic transducer. The acoustic transducer includes a moving diaphragm, a magnetic material including an air gap, a stationary coil, a moving coil and a controller. The stationary coil induces magnetic flux in the magnetic material and the air gap. The magnetic coil is coupled to the diaphragm and is disposed at least partially within the air gap. The controller is configured to receive the input audio signal and to generate a first reference signal indicative of an envelope of the input audio signal. The controller is further configured to provide a stationary coil signal to the stationary coil based on the first reference signal and to measure a current through the stationary coil after providing the stationary coil signal to the stationary coil. The controller is further configured to generate a first output indicative of the current through the stationary coil and to determine a magnetic flux in the air gap based on the first output. The controller is further configured to generate a voltage output for the moving coil that is inversely proportional to the magnetic flux in the air gap. The voltage output provides an undistorted output that corresponds to the input audio signal.

In at least another embodiment, a method is provided that includes receiving an input audio signal and generating, with a controller, a first reference signal indicative of an envelope of the input audio signal. The method further includes providing a stationary coil signal to a stationary coil of an acoustic transducer based on the first reference signal and measuring current through the stationary coil after providing the stationary coil signal to the stationary coil. The method further includes generating a first output indicative of the current through the stationary coil and determining a magnetic flux in an air gap of magnetic material of the acoustic transducer based on the first output. The method further includes generating a voltage output for a moving coil that is inversely proportional to the magnetic flux in the air gap, the voltage output providing an undistorted output that corresponds to the input audio signal.

In at least one embodiment, an acoustic transducer arrangement is provided. The acoustic transducer includes a controller configured to receive an input audio signal and to generate a first reference signal indicative of an envelope of the input audio signal. The controller is further configured to provide a stationary coil signal to a stationary coil of an acoustic transducer based on the first reference signal and to measure a current through the stationary coil after providing the stationary coil signal to the stationary coil. The controller is further configured to generate a first output indicative of the current through the stationary coil and to determine a magnetic flux in an air gap of magnetic material based on the first output. The controller is further configured to generate a voltage output for a moving coil that is inversely proportional to the magnetic flux in the air gap. The voltage output provides an undistorted output that corresponds to the input audio signal.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

Figure 1:
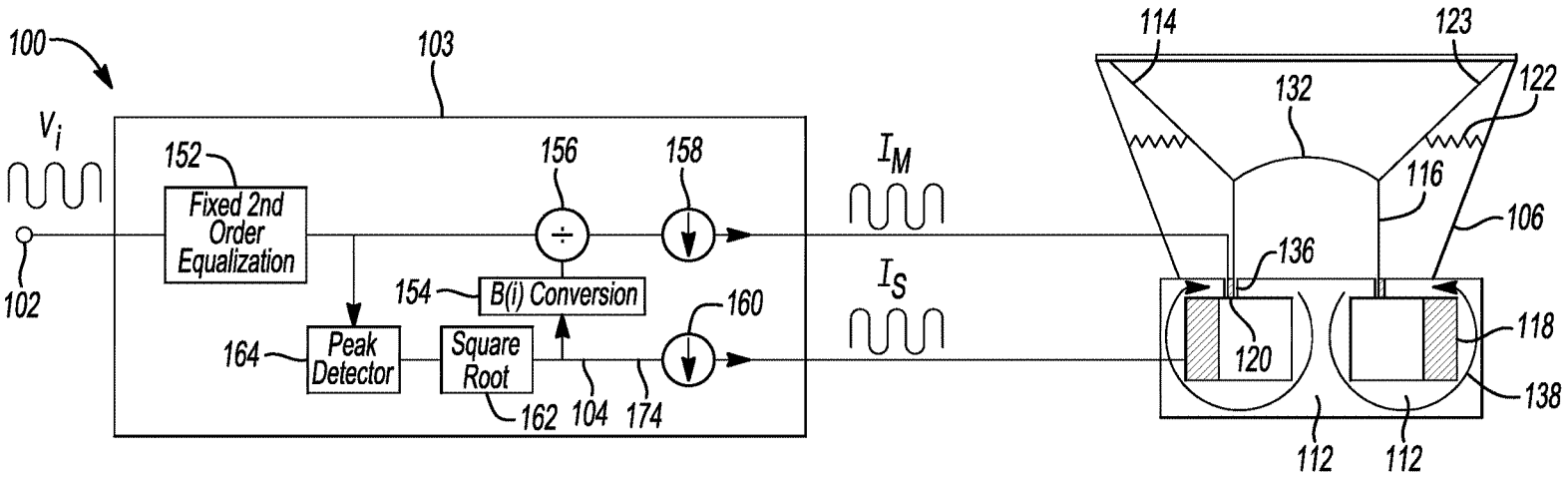
FIG. 1 generally depicts a first acoustic transducer arrangement.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is recognized that the controllers as disclosed herein may include various microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof), and software which co-act with one another to perform operation(s) disclosed herein. In addition, such controllers as disclosed utilizes one or more microprocessors to execute a computer-program that is embodied in a non-transitory computer readable medium that is programmed to perform any number of the functions as disclosed. Further, the controller(s) as provided herein includes a housing and the various number of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The controller(s) as disclosed also include hardware based inputs and outputs for receiving and transmitting data, respectively from and to other hardware based devices as discussed herein.

Aspects disclosed herein generally relate to an electromagnetic acoustic transducer arrangement that, among other things, controls a magnetizing current for a magnetic coil positioned within a driver of an acoustic transducer. Controlling the magnetizing current for the magnetic coil may achieve, but not limited to, an improved transient response, distortion, and efficiency compared to conventional implementations. Additionally, this aspect may add protection, detection, and diagnostics that are suitable for automotive applications.

One conventional acoustic transducer implementation replaces a permanent magnet that is typically used to magnetize a voice coil gap in moving coil transducers with a coil winding and an electrical current to magnetize the gap (i.e., via a magnetic coil "or moving coil"). While the magnetic coil has the potential to reduce the weight and size compared to permanent magnets, unlike permanent magnets, the magnetic coil consumes power when magnetizing the gap. A typical method for reducing the power is to increase a size of the magnetic coil to reduce its resistance. This aspect however negates the potential benefit of the utilizing the magnetic coil in the first place. Thus, this conventional acoustic transducer seeks to reduce the power utilized by the magnetic coil thereby making it possible to use a much smaller magnetic coil while preserving the efficiency. The power savings is achieved by varying the level of current in the magnetic coil in relation to a level of an audio input signal thus only using magnetizing current at times when the audio signal is high.

However, the approach to controlling both a moving coil or voice coil (VC) and the stationary coil or magnetic coil (or moving coil) (MC) utilizes current sources. This implementation may suffer from cost, complexity of hardware, and is unsuitable for automotive applications which typically use a voltage source amplifier in the form of integrated circuits (ICs) for powering the voice coil.

Another conventional approach utilizes voltage sources that provide a voltage to the voice coil and to the moving coil thereby enabling the approach suitable for automotive applications. However, this method results in a more complex algorithm, slower transient response, increased latency, and limited accuracy. In addition, neither of the two conventional methods address the issues of protecting hardware related electronics that are used to generate the voltage or current that is provided to the moving coil. Likewise, neither of the two conventional methods provides fault diagnosis for automotive applications. Moreover, a voltage source impedance characteristic for the moving coil may not be ideal for distortion.

Transducers use either large heavy ceramic (or ferrite) magnets or expensive but light weight neodymium permanent magnets to produce a constant and strong magnetic field against which current in a voice coil produces force to move a cone to produce sound. By replacing the permanent magnet with an electromagnet and by carefully controlling the current in the electromagnet and the stationary coil, the light weight benefit of the neodymium magnet can be achieved without the expense of neodymium. Normally, an electromagnet is inefficient when compared to a permanent magnet because the electromagnet requires current flowing all the time to produce the magnetic field and that current dissipates power in the resistance of the electromagnet's magnetizing coil (or stationary coil). With the acoustic transducer as set forth herein, the efficiency problem may be solved by applying high current to the electromagnet only when the audio signal is large. This means however that the acoustic sensitivity and frequency response of the transducer will be changing which would cause distortion.

In addition, if the current of the electromagnet is low, there will be insufficient time for the electromagnet to be fully magnetized when a transient or sudden burst in the audio signal occurs. Thus, the acoustic transducer as set forth herein seeks to control the current in the stationary coil and the moving coil in a way that optimizes efficiency and transient capability while minimizing acoustic distortion introduced by the changing electromagnets field strength. The acoustic transducer adjusts the magnitude of the current of the moving coil to compensate for the changing sensitivity and adjusts the frequency response of the current of the moving coil current to compensate for the changing acoustic frequency response. The acoustic transducer adjusts the magnitude of the current of the stationary coil so that the long-term average losses in the stationary coil and the long-term losses in the moving coil are reasonably equal and balanced. This ensures optimum efficiency. The acoustic transducer as set forth herein overrides this long-term balance and forces the current of the stationary coil to rise rapidly to fully magnetize the stationary coil when there are large audio transients. To control the current of the stationary coil, acoustic transducer employs a current measurement device, a control system. and a voltage source with an output filter. These aspects and others will be discussed in more detail below.

FIG. 1 generally depicts a first acoustic transducer arrangement 100. The acoustic transducer arrangement 100 includes an input terminal 102, a control block 103, and a transducer 106. An input audio signal (e.g., Vi) is provided to the input terminal 102 of the control block 103. The control block 103 generates a moving coil control signal (e.g. $I_m$) and a stationary coil control signal (e.g., $I_S$). The transducer 106 includes magnetic material 112, a diaphragm 114, a former 116, a stationary coil 118, and a moving coil 120. The moving coil 120 is attached to the former 116.

The magnetic material 112 is generally toroidal and has a toroidal cavity. The stationary coil 118 is positioned within the cavity. In various embodiments, magnetic material 112 may be formed from one or more parts, which may allow the stationary coil 118 to be inserted or formed within the cavity more easily. The magnetic material 112 is magnetized in response to the stationary coil signal thereby producing a magnetic flux in the magnetic material 112. The magnetic material 112 includes a toroidal air gap 136 in a magnetic path 138 and magnetic flux flows through and near the air gap 136.

The magnetic material 112 may be formed of any material that is capable of becoming magnetized in the presence of a magnetic field. In various embodiments, the magnetic material 112 may be formed from two or more such materials. In some embodiments, the magnetic material 112 may be formed from laminations. In some embodiments, the laminations may be assembled radially and may be wedge shaped so that the composite magnetic material is formed with no gaps between laminations.

The moving coil 120 is mounted on the former 116 and receives the moving coil signal from the control block 103. The diaphragm 114 is mounted to former 116 such that diaphragm 114 moves together with the former 116 and the moving coil 120. The former 116 and the moving coil 120 move within the air gap 136 in response to the moving coil signal and the flux in the air gap 136. In general, the various components of the acoustic transducer 106 that move with the former 116 may be referred to as moving components. Components that are stationary when the former 116 is in motion may be referred to as stationary components. Stationary components of the acoustic transducer 106 generally include the magnetic material 112 and the stationary coil 118.

In various embodiments, the acoustic transducer 106 may be adapted to vent air space between a dust cap 132 and the magnetic material 112. For example, an aperture may be formed in the magnetic material 112, or apertures may be formed in the former 116 to enable the air space to vent thereby reducing or preventing air pressure from affecting the movement of the diaphragm 114.

The control block 103 generally includes a filter 152 (e.g., $2^{nd}$ order filter), a conversion circuit 154, a divider circuit 156, a first current source 158, a second current source 160, a square root circuit 162, and a peak detector circuit 164. In general, the transducer arrangement 100 utilizes the first current source 158 and the second current source 160 to replace voltage sources which enable the transducer arrangement 100 suitable for automotive applications. However, the transducer arrangement 100 utilizes a complex algorithm that provides for a slower transient response, increased latency, and limited accuracy. Additionally, the transducer arrangement 100 fails to address issues pertaining to the protection of electronic circuits generally associated with the moving coil 120 (or voice coil) or fault diagnosis required for automotive applications. Moreover, the voltage source impedance characteristic for the magnetizing coil (or the stationary coil 118) may not be ideal for distortion.

There is generally a need for a control method for providing currents to the stationary coil 118 and the moving coil 120 which incorporate benefits of both voltage and current sources and improves the transient response and provides improved latency, accuracy, as well as suitable protection and diagnostics. Referring back to the arrangement 100 as illustrated in FIG. 1, the control block 103 provides for a simplified frequency compensation by utilizing the first current source 158 for providing the moving coil signal (e.g., $I_m$) (or the voice coil signal). The first current source 158 eliminates the damping effect of a resistance of the moving coil 120 because the current (i.e., the moving coil signal) doesn't depend on an impedance of the moving coil 120. Therefore, the frequency response of the transducer 106 no longer depends on the moving coil signal (i.e., current) and is instead fixed. This aspect enables a single fixed non-time varying $2^{nd}$ order filter 152 to be used to compensate the frequency response.

The optimum efficiency for the transducer 106, including both the power for the stationary coil 118 and the moving coil 120 is achieved when the powers for the stationary coil 118 and the moving coil 120 are balanced (i.e., up to the point that a motor assembly steel for the transducer 106 begins to saturate, at which point a further increase of the current of the stationary coil 106 has no benefit. With the transducer arrangement 100, this is approximated via the square root circuit 102 of the audio signal level peak that is detected by peak detector 164 to set the current for the stationary coil 118 since the power in resistance is proportional to the current squared. To use an output 104 from the square root circuit 162 directly, a proportional current source (i.e., the second current source 160 is used to drive the stationary coil 118.

Lastly, to compensate for the changing sensitivity of the output 104 which is directly proportional to the stationary coil signal (or current for the stationary coil 120), the conversion circuit 154 can be used to calculate the magnetic flux in the air gap 136 of the moving coil 120 with a function B(i). Since the sensitivity of the transducer 106 is directly proportional to the flux in the air gap 136 of the moving coil 120, a frequency compensated audio signal as provided by the filter 102 can be divided the divider circuit 156 with B(i) to achieve constant overall sensitivity.

However, as noted above, this approach may provide two drawbacks. First, the first current source 158 and the second current source 160 may be difficult to implement and the first current source 158 may not be compatible with voltage source IC amplifiers used in automotive applications. In addition, the second current source 160 may need to handle high voltages which result from a transformer coupled voltage of the moving coil 120 onto the stationary coil 118 multiplied by the turns ratio of the moving coil 120 and the stationary coil 118. This implementation may cause the second current source 160 to be expensive to implement.

Figure 2:
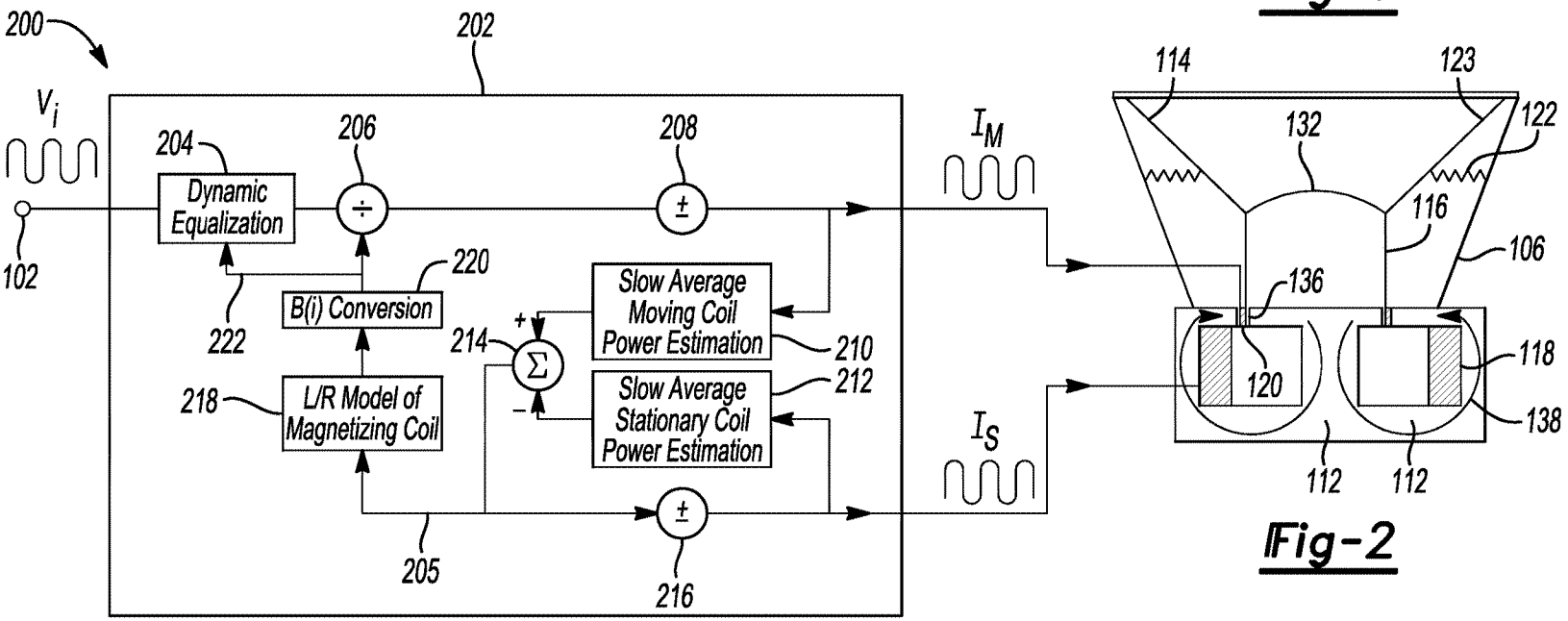
FIG. 2 generally depicts a second acoustic transducer arrangement.

FIG. 2 generally depicts a second acoustic transducer arrangement 200. The transducer arrangement 200 generally includes the transducer 106 and a control block 202. The control block 202 generally includes a dynamic equalization block 204, a divider circuit 206, a first voltage source 208, moving coil power estimation block 210, a stationary coil power estimation block 212, an subtractor circuit 214, a second voltage source 216, a stationary coil modeling block 218, and a conversion circuit 220. In general, the first voltage source 208 and the second voltage source 216 replace the first current source 158 and the second current source 160 as generally shown in connection with FIG. 1. In this case, the filter 152 of the control block 103 in FIG. 1 can no longer be fixed as the impedance of the moving coil 120 may no longer be negated by the first current source 158. With the arrangement 200, the dynamic equalization block 204 provides a transfer function that is representative of the magnetic flux in the air gap 136 of the moving coil 120 with a function B(i) as provided by the conversion circuit 220.

The divider circuit 206 divides the audio signal by the changing flux density calculated by the conversion circuit 220. However, now that the second voltage source 216 (see replaces the second current source 160, a target output current 205 is no longer directly proportional to the actual current of the stationary coil 118 due to the impedance of the stationary coil 118. To compensate for this aspect, the stationary coil modeling block 218 (e.g., inductance model) assumes that the resistance of the stationary coil 118 is known. In practice, it is not because of temperature effects which can change the resistance by 50% or more. These errors lead to errors in both frequency compensation and sensitivity compensation both in the steady state and in transient conditions when the current for the stationary coil 118 is changing.

It is recognized that the optimum efficiency for the transducer 106 may be achieved when the powers for the stationary coil 118 and the moving coil 120 are balanced. Thus, the arrangement 200 utilizes a square root approximation method. For example, the moving coil power estimation block 210 determines the average power for the moving coil 120 and the stationary coil power estimation block 212 determines the average power for the stationary coil 118. The subtractor circuit 214 compares the power for the moving coil 120 and the power for the stationary coil 118. If the average power for the moving coil 120 is greater than the average power for the stationary coil 118, then the subtractor circuit (or difference block) 214 increases the output 205 which is used as a target current (or the stationary coil signal) for the stationary coil 118. This condition causes a decrease in power to the moving coil 120 and balances the powers between the stationary coil 118 and the moving coil 120.

However, the average power should be estimated over a significantly longer period to avoid distortion and may be between 0.1 sec and 1 sec. This entails that in transient conditions, when the audio signal rapidly increases in level, the stationary coil signal (or current for the stationary coil 118) does not track quickly. The result is that the sensitivity of the transducer 106 remains low for a long period of time during a transient and therefore needs a significantly higher transient moving coil 120 amplifier peak power or the output SPL of the transducer 106 may be limited during transients. Additionally, the slow tracking of the stationary coil signal relative to a level of the input audio signal can compromise efficiency because the balance of powers may not be maintained when the level of the input audio signal has a high dynamic content.

Figure 3:
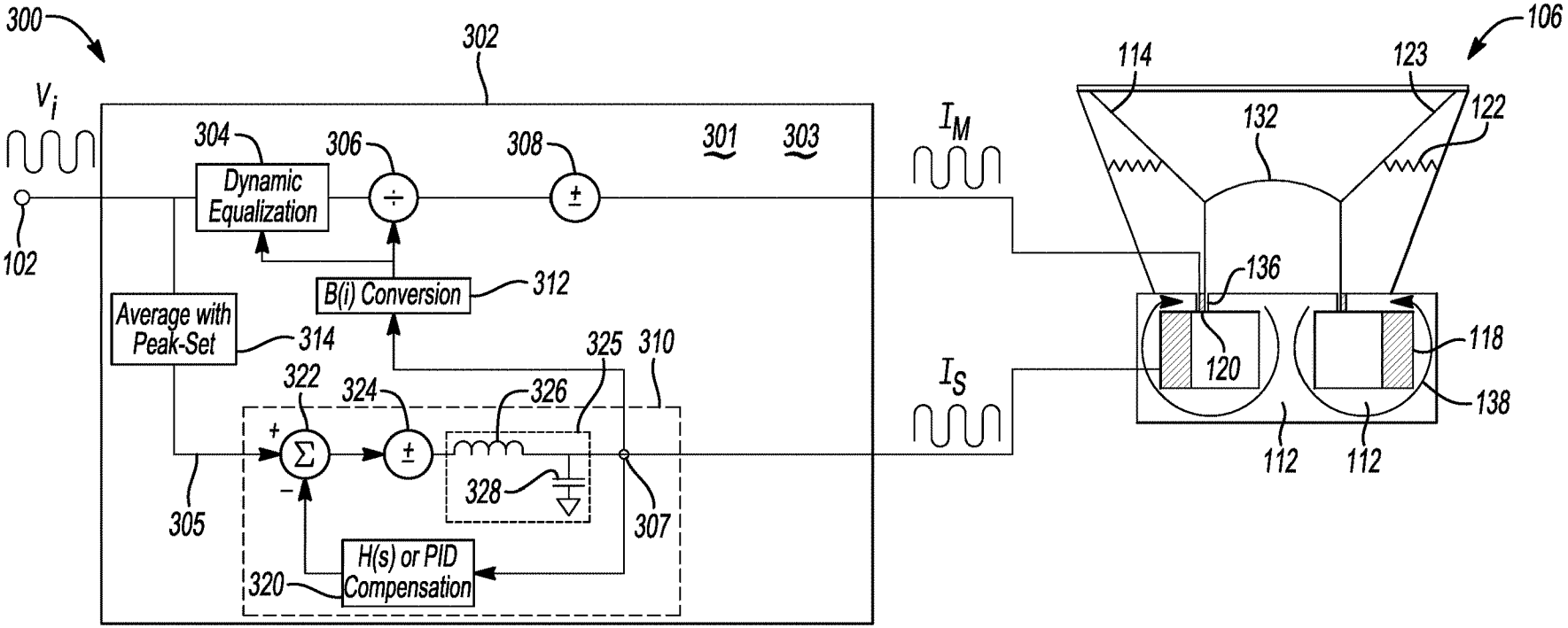
FIG. 3 generally depicts one implementation of an acoustic transducer arrangement in accordance to one embodiment.

FIG. 3 generally depicts one implementation of an acoustic transducer arrangement 300 in accordance to one embodiment. The acoustic transducer arrangement 300 includes the transducer 106 and an acoustic transducer controller (or controller) 302. The acoustic transducer controller 302 generally includes at least one digital processor 301 and memory 303. The digital processor 301 generally executes functions performed by the controller 302. The controller 302 generates and transmits the moving coil signal and the stationary coil signal to the moving coil 120 and the stationary coil 118, respectively in response to the receiving the input audio signal at the input 102.

The arrangement 300 is generally configured to balance the powers between the stationary coil 118 and the moving coil 120 while achieving a fast transient response, improve the accuracy of frequency and sensitivity compensation in the presence of the changing current (i.e., the changing stationary coil signal) for the stationary coil 118, and improve the efficiency of the transducer 106, without relying on current sources to generate the stationary coil signal and the moving coil signal without introducing distortion. Moreover, as will be described in more detail, the arrangement 300 is generally configured to provide protection and diagnostics for electronics used in connection with the stationary coil 118.

The controller 302 includes a dynamic equalization block 304, a divider circuit 306, a voltage source 308, a complex source block 310, a conversion circuit 312, and a peak-set block 314. The complex source block 310 is provided to replace the second current source 160 as noted in connection with FIG. 1 and to replace the second voltage source 216 as noted in connection with FIG. 2. In general, the complex source block 310 is configured control or tailor its impedance to generate the stationary coil signal (Is) for transmission to the stationary coil 118.

The average with peak-set block 314 takes peak values of the input audio signal and uses a low pass filter to remove the ripple associated with a simple peak detector (similar to the peak detector 164 of FIG. 1). During a transient the slow changing low pass filter is forced to respond immediately to the transient by setting the value of the low pass filter directly to an instantaneous maximum absolute value of the input audio signal. In this way, a clean envelope of the input audio signal, with minimal ripple, of the input audio signal can be generated that can respond to transient increases in the level of the audio signal, and be provided as a reference signal 305 to the complex source block 310.

With this arrangement 300, the level of the input audio signal can be used without the square root circuit 162 (or square root function) because the output voltage of the source for the stationary coil 118 is a known voltage where the power is proportional to voltage squared. This means that the power in the moving coil 120 is proportional to the power in the stationary coil 118 since the stationary coil signal (or current provided to the stationary coil 118) is proportional to the input audio signal via the reference signal 305 and power in the moving coil 120 is proportional to the current of the stationary coil 120 squared. This approach may not be as accurate as the power balance performed by the moving coil estimation block 210 and the stationary coil estimation block 211 because the noted approach ignores the effect of the frequency dependent impedance of the moving coil 120. However, for a musical and noise signal, an average scaling value can be chosen to approximate well enough the effect of the impedance of the moving coil 118 with music and noise.

The complex source block 310 measures the current provided to the stationary coil 118 (or the stationary coil signal) with a current measurement circuit 307. The current measurement circuit 307 may be a resistor, a current transformer, hall effect sensor, etc. The measured current (i.e., the measure stationary coil signal) is provided as a feedback to the compensation block 320 to provide an error signal to the adder circuit 322. The adder circuit 322 compares the reference signal 305 to the error signal (or subtracts the error signal from the reference signal 305) and adjusts the voltage source 324. It is recognized that the voltage source 324 may be implemented as pulse width modulated ("PWM") (or other modulation scheme) buck (or other topology) regulator along with the filter 325. The filter 325 generally includes the inductor 326 and the capacitor 328 to filter the voltage output from the voltage source 324. The compensation block 320 and the filter 325 generally have output an impedance such that the complex source block 310 looks like a current source, a voltage source, or a desired case of a mixed frequency dependent source. In particular, it may be desirable for the complex source block 310 to behave as a current source at low frequencies and as a voltage source at frequencies above a mechanical resonance of the transducer 106 (e.g., 50-100 Hz for a 6 inch mid-bass driver). This aspect may improve distortion in a pass band of the transducer 106 while providing accurate control over the average current of the stationary coil (or average of the stationary coil signal) and transient levels. To achieve the behavior of an impedance with the complex source block 310, the compensation block 320 may be implemented as, for example, a Proportional-Integral-Derivative (PID) controller. For example, the compensation block 320 may include a proportional path with a gain "Kp" in the current feedback path where the current of the stationary coil signal is measured by the current measurement circuit 307. The integral and derivative terms (i.e., Ki and Kd) may be, for example, zero. Using the proportional current feedback K (i.e., Ki and Kd=0) is sufficient for the filter 325. The integral term, Ki and the derivative term, Kd are stable because the $2^{nd}$ order system created by the inductor 326 and the capacitor 228 is reduced to a first order system by virtue of current measurement with current measurement circuit 307 and a proportional current feedback, Kp. By using the proportional current feedback Kp in the feedback path, this condition creates an effective current source.

In this arrangement, the inductance of the inductor 326 is effectively eliminated (in a stability sense) by the current source created by using current feedback. By selecting the proper gain, Kp, in the feedback path for the compensation block 320, the frequency at which the natural impedance of the capacitor 328 has an effect on the output impedance can be tailored. The higher the gain for Kp, the higher the frequency will be. At high frequencies, the impedance provided by the complex source block 310 is dominated by the impedance of the capacitor 328 and thus looks like a voltage source. For this to be true, the size of the capacitance of the capacitor 328 should be sufficient that at the desired frequency above the resonance of the transducer 106, the impedance of the capacitor 328 is similar to or smaller than an impedance of the transducer 106. At low frequencies, where the impedance of the capacitor 328 is high, the output current will be dominated by the effective current source created by using current feedback. Thus, the control block 301 may provide the characteristic impedance of a current source at low frequencies and the characteristic impedance of a voltage source at high frequencies. Where the higher frequency is generally 3 to 5 times the mechanical resonance of the transducer 106 and the low frequency is generally any frequency that is below the high frequency. Finally, it is recognized that this same effect may be achieved by other control approaches such as, for example, utilizing voltage sensing and adding an integral term Ki as well as proportional term Kp and possibly a derivative term Kd for stability. The foregoing may be represented in the s-domain or z-domain.

In addition, in a system were more than one stationary coil 118 is to be fed current, it is possible to connect loads of the stationary coils 118 in parallel with one another and to use one control loop and a voltage source. However, to make the arrangement failsafe at an input between the controller 302 and the stationary coil 118, the measured current at the current measurement circuit 307 in the feedback path mentioned above may be the higher of the multiple currents of the stationary coils 118 at any instant in time. In this way, the current of the stationary coil 118 is regulated to load of the stationary coil 118 that provides the highest current.

In general, the level of current of the stationary coil 118 to optimize efficiency of the arrangement 300 is generally determined by the peak-set block 314. For example, the peak-set block 314 receives either the input audio signal or the output from the dynamic equalization block 304. It is preferable that the peak-set block 314 receives the input audio signal. This arrangement assists in avoiding large variations in desired current of the stationary coil 118 near a resonance of the transducer 106. At a near resonance, less power is needed to produce the same acoustic output level. For this reason, the arrangements 100 and 200 may generally result in the current of the stationary coil 118 being reduced at a resonance to balance the power. However, as the current of the stationary coil 118 is reduced, the damping is reduced requiring even less power for the moving coil 120 which leads to a further reduction in the current of the stationary coil 118. This result can lead to an error near resonance in both the sensitivity and frequency response because the transducer 106 may be almost entirely damped by its mechanical losses. Thus, by providing the input audio signal to the peak-set block 314 prior to the dynamic equalization block 304, this condition bypasses the error noted above. While this may entail that the power balance between the stationary coil 118 and the moving coil 120 may not be maintained near resonance, this aspect may not matter because the power levels of the stationary coil 118 and the moving coil 120 are low near resonance.

The conversion circuit 312 may receive the measured current of the stationary coil 118 (i.e., the stationary coil signal) to determine the flux density in the air gap 136. The determined flux density in the air gap 136 is used to determine the changing acoustic frequency response and acoustic sensitivity of the transducer 106 as a function of the current of the stationary coil 118. If the measured current of the stationary coil 118 is used determine the magnetic flux in the air gap 136, then the divider circuit 306 may correct the sensitivity of the stationary coil 118. However, distortion may occur at some frequencies and levels if the measured current of the moving coil 120 is used to directly to determine the magnetic flux in the air gap 136 and hence sensitivity and frequency response.

In general, the stationary coil 118 replaces conventional magnets that are generally used to generate magnetic flux in the air gap 136 to enable the transducer 106 to output audio. However, the stationary coil 118 utilizes a lot of current when it is required for the transducer 106 to output high peaks of audio (i.e., drum roll, etc.). Thus, the controller 302 adjusts the current on Is based on the envelope of the input audio signal. The controller 302 lowers the current on Is when it is not necessary to output a high level of audio and increases the current on Is when it is necessary to output a high level of audio (i.e., provide dynamic adjustment of current).

The control block 310 provides the output current Is to conversion block 312 which provides a value corresponding to the magnetic flux in the air gap 136. The dynamic equalization block 304 uses the flux value to provide the same frequency response for the input audio signal. The control block 310 has an impedance characteristic of a voltage source or a current source. The control block 310 forces the current of Is to climb quickly and quietly when the audio input signal has a large level.

The stationary coil 118 and the moving coil 120 are transformer coupled via the magnetic material 112. Consequently, a current in the moving coil 120 will produce a transformer coupled or reflected current in the stationary coil 118. At frequencies and signal levels where the reflected current of the moving coil 120 is large compared to the average of the current of the stationary coil 118, this distortion will be more prevalent or significant. Referring to FIG. 3, when the stationary current is measured with a current measurement circuit 307, the measurement may include a current that is reflected from the current of the moving coil 120. However, the controller 302 may use the measured current to determine an acoustic sensitivity of the transducer 106. When the current phase relationship of the moving coil 120 is correct, the reflected current of the moving coil 120 to the stationary coil 118 may subtract from the average current of the stationary coil 118 thereby causing the conversion circuit 302 to calculate a lower flux density in the gap 136 and consequently lower sensitivity. This may provide a smaller signal in the denominator of the divider 306 resulting in an increase in the current in the moving coil 120. This aspect may reflect more current in the stationary coil 118 which will subtract further from the average current in the stationary coil 118 causing the conversion circuit 302 to calculate a yet lower flux density in the gap 136 and ultimately increase in the current of the moving coil 120. Thus, a positive feedback is established which causes the aforementioned distortion.

In the opposite phase, the current of the moving coil 120 can add to the average of the current of the stationary coil 118 causing the conversion block 302 to calculate a higher flux density in the gap 136. This provides the same positive feedback which then results in distortion. The result is that at some frequencies, the resulting output signal is asymmetrically distorted with large even order distortion components. In one aspect, it may be advantageous to separate the effect of the current of the moving coil 120 reflected to the stationary coil 118 that is used to determine the sensitivity compensation and also the frequency compensation.

Figure 4:
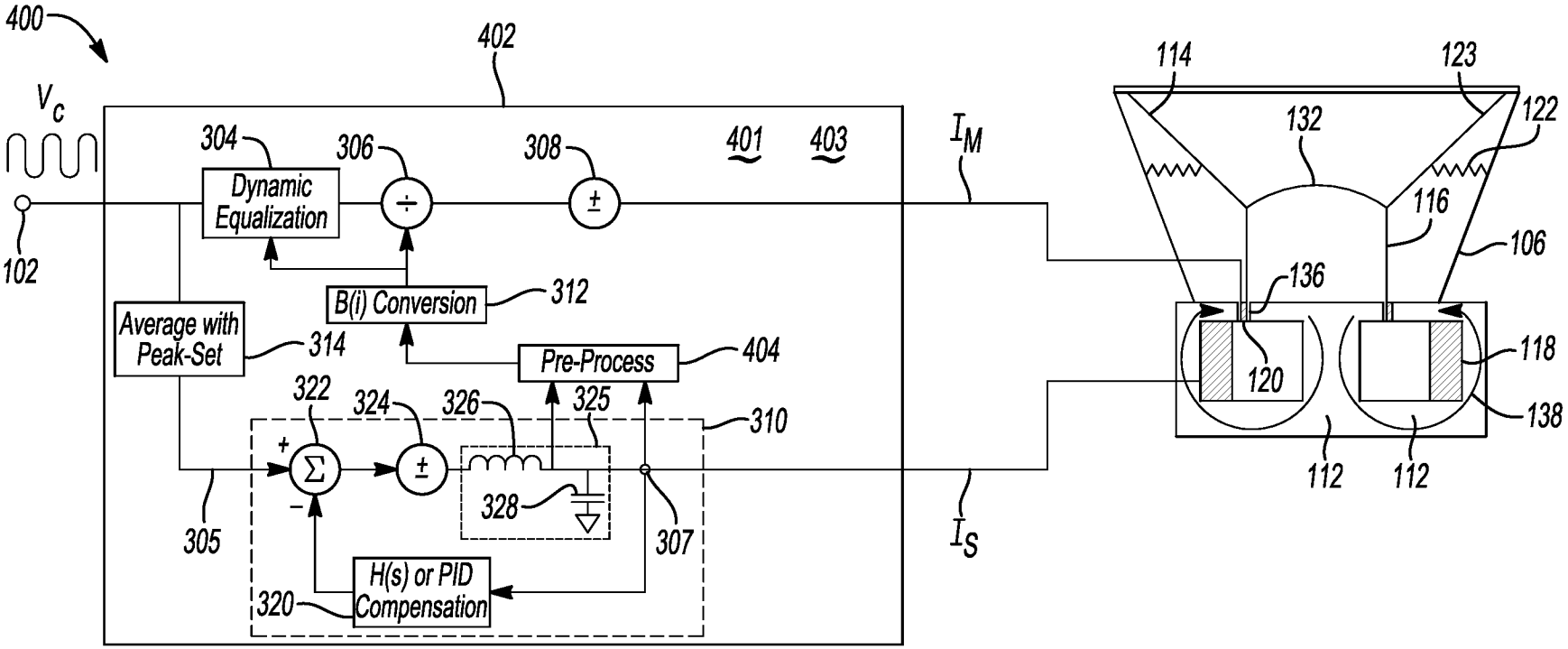
FIG. 4 generally depicts another implementation of the acoustic transducer arrangement in accordance to another embodiment.

FIG. 4 generally depicts another implementation of the acoustic transducer arrangement 400 in accordance to another embodiment. The acoustic transducer arrangement 400 includes the transducer 106 and an acoustic transducer controller (or controller) 402. The acoustic transducer controller 402 generally includes at least one digital processor 401 and memory 403. The digital processor 401 generally executes functions performed by the controller 402. The acoustic transducer controller 402 generates and transmits the moving coil signal and the stationary coil signal to the moving coil 120 and the stationary coil 118, respectively in response to the receiving the input audio signal at the input 102.

The controller 402 generally includes the dynamic equalization block 304, the divider circuit 306, the voltage source 308, the complex source block 310, the conversion circuit 312, the peak-set block 314, and a pre-processing block 404. With the arrangement 400, the measured current of the stationary coil 118 is not directly used to determine the magnetic flux of the air gap 136 of the moving coil 120. Rather, the pre-processing block 404 pre-processes the measured current of the stationary coil 118. For example, the pre-processing block 404 takes the long-term average voltage amplitude of the stationary coil 118 which is measured at current measurement circuit 307 to determine the average resistance of the stationary coil 118. The average resistance of the stationary coil 118 is used in an L/R model of the stationary coil 118 to predict an effective average current of the stationary coil 118 which then will be absent the reflected current from the moving coil 120. The L/R model is similar to that of a stationary coil modeling block 218 but where the resistance R of the stationary coil has been measured and thereby included more accurately. In this case, a resistance and an internal temperature of the moving coil 120 may be known on an accurate basis which assists in predicting the effective average current of the stationary coil 118. It is recognized that the resistance of the moving coil 120 may be difficult to calculate when the current of the stationary coil 118 is low, and the inductance is generally an ideal approximation of an actual inductance of the stationary coil 118 which may include all of the non-ideal aspects of an inductor such as magnetic remanence, saturation, and other effects in the steel.

The pre-processing block 404 is configured to take a fast average with a peak-set function of the measured current. The pre-proceeding block 404 first takes a peak detected value of the measured current of the stationary coil 118 and then utilizes a low pass filter therein to average the peak detected values. The filtering removes most of the reflected current from the moving coil 120 from the measured current of the stationary coil 118. To respond to transient, fast climbing currents of the stationary coil 118, a value of the pass filter may be forced to the peak value during a fast climbing stationary current. This may be optimal to eliminate the distortion issue noted above except with pure sine waves with frequencies below the cutoff frequency of the low pass filter where the filter is no longer able to estimate the average stationary current.

Figure 5:
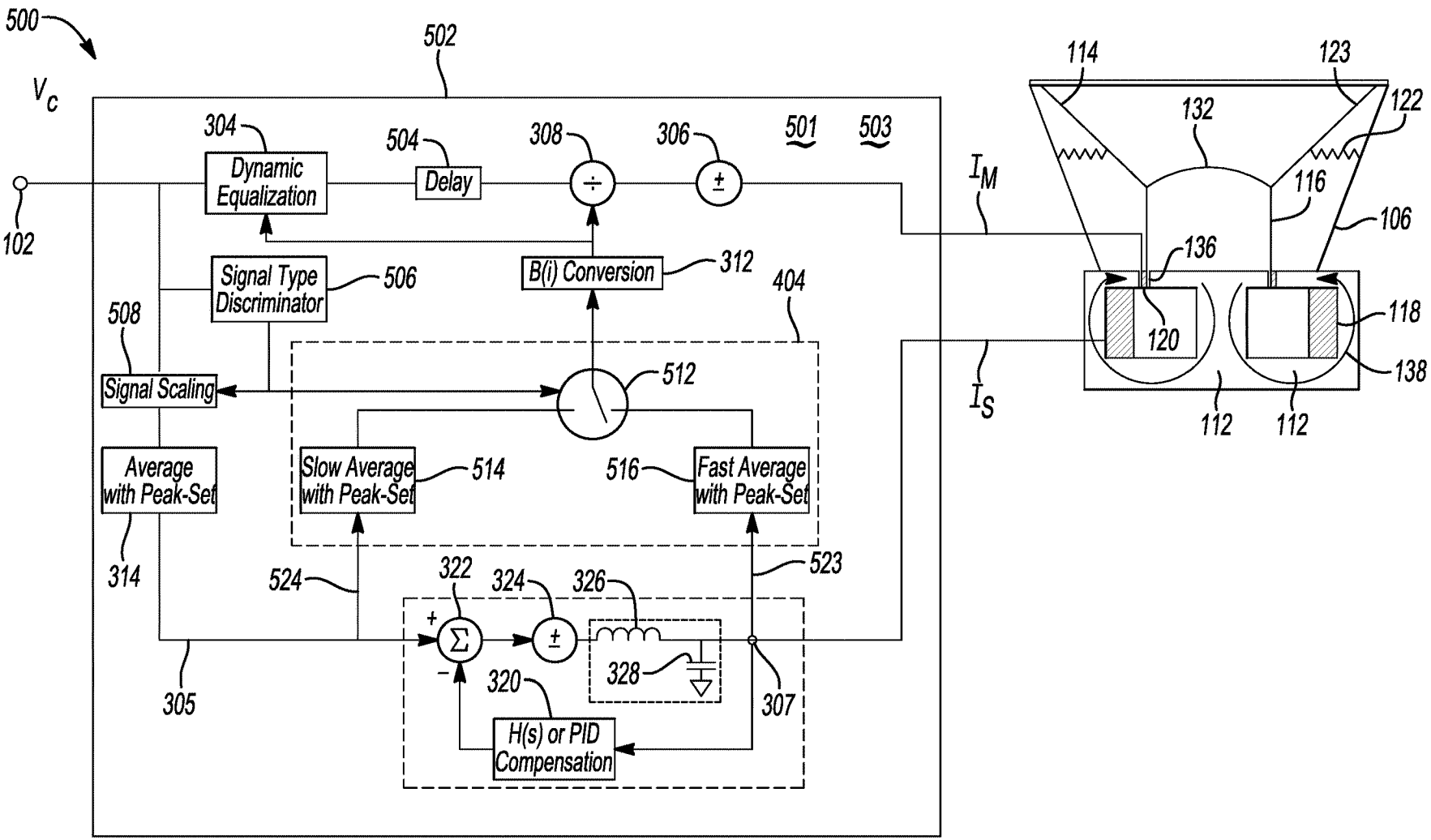
FIG. 5 generally depicts another implementation of the acoustic transducer arrangement in accordance to another embodiment.

FIG. 5 generally depicts another implementation of the acoustic transducer arrangement 500 in accordance to another embodiment. The acoustic transducer arrangement 500 includes the transducer 106 and an acoustic transducer controller (or controller) 502. The acoustic transducer controller 502 generally includes at least one digital processor 501 and memory 503. The digital processor 501 generally executes functions performed by the controller 502. The controller 502 generates and transmits the moving coil signal and the stationary coil signal to the moving coil 120 and the stationary coil 118, respectively, in response to the receiving the input audio signal at the input 102.

The controller 502 generally includes the dynamic equalization block 304, the divider circuit 306, the voltage source 308, the complex source block 310, the conversion circuit 312, the peak-set block 314, the pre-processing block 404, a delay block 504, a signal type discriminator block 506, and a signal scaling block 508. A feedback path 523 and a feedforward path 524 are shown as providing inputs to the pre-processing block 504. For example, the pre-processing block 504 includes the peak-set block 314, a switch 512, and a fast average peak-set block 516. The signal type discriminator block 506 is provided to select the switch 512 such that the feedback path 523 or the feedforward path 524 is selected to provide an input to the conversion circuit 312 coming from either the slow average peak-set block 514 or the fast average peak-set block 516.

The signal type discriminator block 506 determines when the input audio signal is below the cutoff frequency of the low pass filter of the pre-processing block 404 or is primarily a sine-wave in nature (e.g., a single tone or test signal with a single frequency). If this condition is true (i.e., the input audio signal is a sine-wave), then the slow average peak-set block 514 can be used in feedforward path 524 with switch 512 as the input to the conversion circuit 312. As noted above, the average with peak-set block 314 provides the target current of the stationary coil 118. This mode eliminates the effect of the reflected current of the moving coil 120 by eliminating the feedback path 523 as the feedback path is not is use. In addition, the slow average peak-set block 514 includes a fast peak-set function in the same way that the average peak-set block 314 has, to allow fast transients to set the output of block 514 to eliminate the delay associated with the averaging filter.

The signal scaling block 508 scales the level of the target current of the stationary coil 118 based on the nature of the input audio signal as detected by the signal type discriminator block 506. In this way, an optimum current of the stationary coil 118 is provided to balance the power for sine-waves and a different optimum current for noise or music signals which can be better maintained, sine-waves having a lower peak to average than noise or music. In addition, the delay block 504 provides additional time for the current of the stationary coil signal to rise to target current of the stationary coil 118 particularly during fast transients. In general, the delay block 504 receives the output from the dynamic equalization block 304 before the divider circuit 398 to ensure proper operation.

The size of the delay employed by the delay block 504 may depend on the voltage available to drive the current of the stationary coil 118 as determined by the power electronics employed such as the power supply for the voltage source 324, the inductance and resistance of the stationary coil 118, the bandwidth of the arrangement 500 and therefore the slew rate of the transient being reproduced and secondary factors such as the amplifier headroom. In some cases, delay may not be required.

Figure 6:
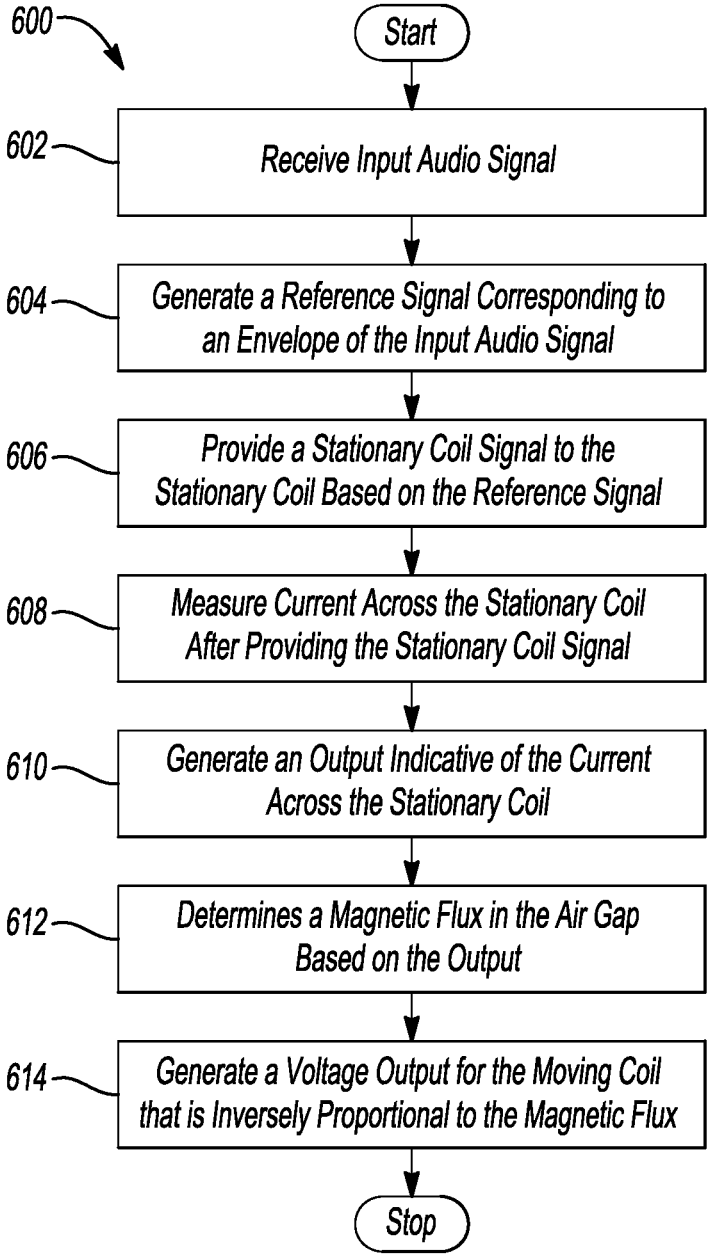
FIG. 6 generally depicts a method for executing at least a portion of the implementation of the acoustic transducer arrangement of FIG. 3.

FIG. 6 generally depicts a method 600 for executing at least a portion of the implementation of the acoustic transducer arrangement 300 of FIG. 3.

In operation 602, the acoustic transducer controller 302 receives the input audio signal which corresponds to a target audio signal that is to be played back by the transducer 106.

In operation 604, the average with peak set block 314 generates the reference signal 305 which corresponds to an envelope of the input audio signal. The envelope generally corresponds to a smooth curve that is defined by an upper extreme of the input audio signal and a lower extreme of the input audio signal. Specifically, the envelope of the input audio signal generally corresponds to an absolute value of the energy of the input audio signal between the upper extreme and the lower extreme of the input audio signal. The average with peak set block 314 obtains the envelope of the input audio signal using a peak detector followed by an averaging low pass filter to remove a ripple associated with the simple peak detector. The decay rate of the peak detector should be similar to the La time constant of the stationary coil to achieve optimum efficiency. The cut off frequency of the low pass filter should be below the pass band of the transducer 106. During a transient whose magnitude is above the then current level in the low pass filter, the slow changing low pass filter is forced to respond immediately to the transient higher level by setting the value of the low pass filter directly to an instantaneous maximum absolute value of the input audio signal. In this way, a clean envelope of the input audio signal, with minimal ripple, of the input audio signal can be generated that may still respond to transient increases in the level of the audio signal, and be provided as the reference signal 305 to the complex source block 310.

In operation 606, the complex source block 310 provides the stationary coil signal to the stationary coil 118 based on the reference signal 305.

In operation 608, the current measurement circuit 307 measures the current through the stationary coil 118 after providing the stationary coil signal to the stationary coil 118.

In operation 610, the complex source block 310 generates an output indicative of the measured current through the stationary coil 118.

In operation 612, the conversion circuit 312 the amount of magnetic flux is present in the air gap 136 based on the output.

In operation 614, the acoustic transducer controller 302 generates a voltage output for the moving coil 120 that is inversely proportional to the magnetic flux. For example, the divider circuit 306 takes the inverse of the magnetic flux as received from the conversion circuit 312 and provides an output to the voltage source 308 such that the voltage source 308 provides a voltage that is inversely proportional of the magnetic flux value from the conversion circuit 312. Since the voltage output is proportional to product of the magnetic flux, $\beta$ and current, I (i.e., $\beta \times I$) whereby the current is proportional to voltage. Thus, if the magnetic flux is reduced, the voltage output is proportionally increased to avoid distortion.

Figure 7:
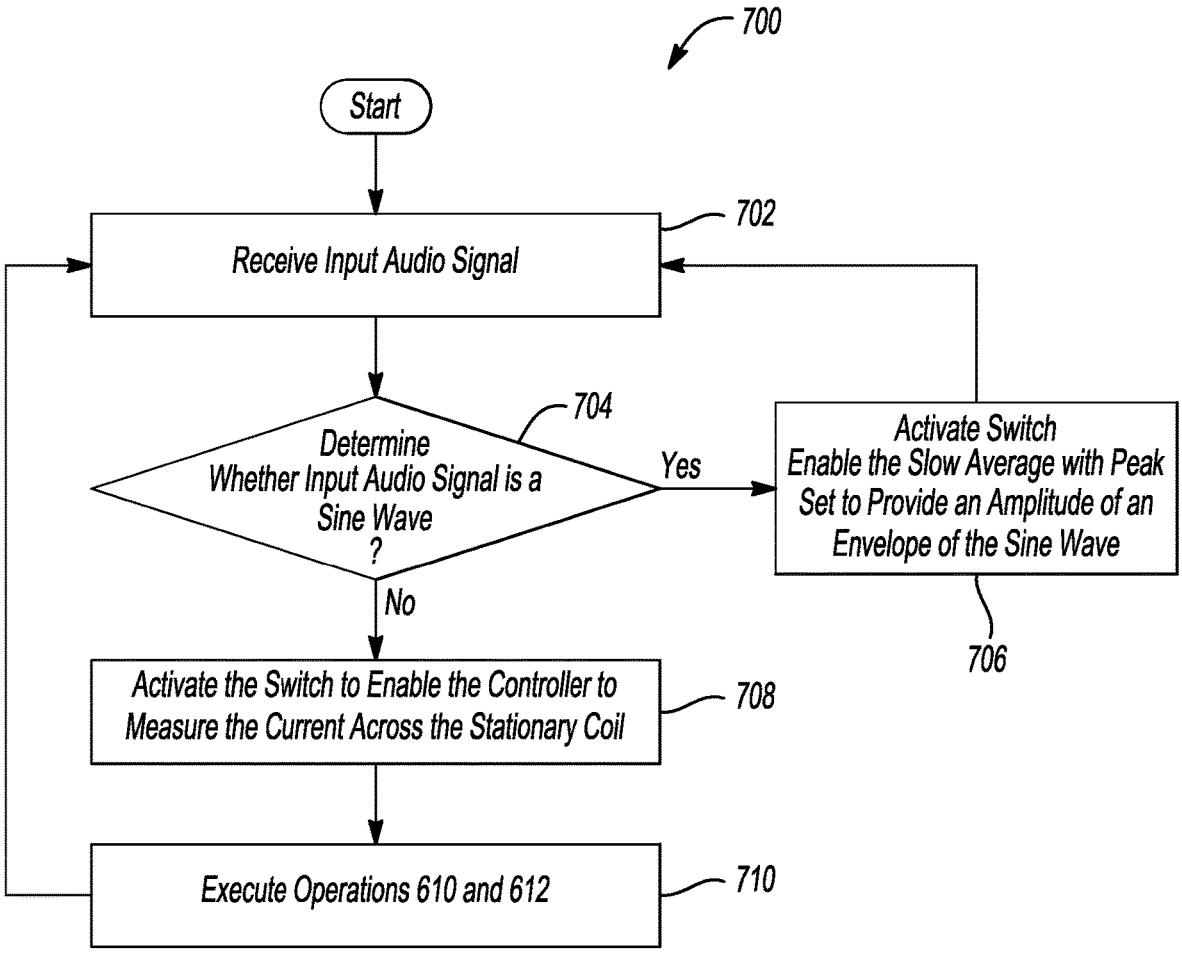
FIG. 7 generally depicts a method for executing at least a portion of the implementation of the acoustic transducer arrangement of FIG. 5.

FIG. 7 generally depicts a method 700 for executing at least a portion of the implementation of the acoustic transducer arrangement 500 of FIG. 5.

In operation 702, the acoustic transducer controller 502 receives the input audio signal.

In operation 704, the signal type discriminator block 506 determines whether the input audio signal is a pure tone (or test) signal or an audio signal that includes a plurality of frequencies. For example, the signal type discriminator 506 determines whether the input audio signal includes a sine wave (or comprises a single frequency) as noted above. If this condition is true, then the method 700 moves to operation 706. If this condition is false, the signal type discriminator 506 determines that the input audio signal includes a plurality of frequencies and the input audio signal corresponds to an audio input that is desired for playback for the user for entertainment consumption. For example, the signal type discriminator block 506 monitors the peak/average value (or p/a) of the input audio signal. A pure sine wave has a p/a of 1/0.63 or 1.45 whereas music or noise has a p/a from 2-10. Thus, in the event the signal type discriminator block 506 determines a p/a that is approximately 1.5, then the signal type discriminator block 506 determines that the input audio signal is a pure tone (or test signal). In the event the signal type discriminator block 506 determines that a p/a of input audio signal is within 2-10, then the signal type discriminator block 506 determines that the input audio signal is an audio signal.

In operation 706, the signal type discriminator block 506 controls the switch 512 to enable the slow average peak-set block 514 in the feedforward path 524 to provide an output from the average with peak set 314 to the input to the conversion circuit 312. In general, the slow average peak-set block 514 is similar to the average with peak set block 314 in operation but with a slow averaging low pass filter compared to that used in 314. For example, 0.1 to 1 Hz. This operation provides a ripple free envelope of the input sine wave. The conversion circuit 312 converts the current of the stationary coil 118 to the magnetic flux density. The dynamic equalization block 304 and the divider 306 use the magnetic flux density as output from the conversion circuit 312 to the input audio signal to compensate the stationary coil signal for changes in flux density.

In operation 708, the signal type discriminator block 506 activates the switch 512 to enable the output of the current measurement circuit 307 to provide the output corresponding to the measured current through the stationary coil 118 to the fast average with peak set block 516 and then to the conversion circuit 512. The fast average with peak-set block 516 functions similarly to the average with peak set block 314 however the cutoff frequency of the averaging low pass filter of the fast average with peak set block 516 is comparable to the resonance of the transducer 106. This duplicates the operation of pre-processing block 404 with input audio signals. The fast average with peak set block 516 provides an envelope of the current through the stationary coil 120 when the envelope corresponds to rapid changes in the measured current.

In operation 710, the acoustic transducer controller 502 performs similar operations as noted above in connection with operations 610 and 612.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An acoustic transducer arrangement comprising:
an audio input terminal to receive an input audio signal having a frequency;
an acoustic transducer including:
a moving diaphragm;
a magnetic material including an air gap;
a stationary coil to induce magnetic flux in the magnetic material and the air gap; and
a moving coil coupled to the diaphragm and being disposed at least partially within the air gap; and
a controller configured to:
receive the input audio signal;
provide a moving coil signal to the moving coil; and
operate as one of a current source or a voltage source to provide a stationary coil signal to the stationary coil to induce the magnetic flux in the magnetic material based on a value of the frequency and on a mechanical resonance of the acoustic transducer,
wherein the controller includes a compensation block and a filter that includes a capacitor and an inductor to provide an impedance such that a complex source block operates as the one of the current source or the voltage source, and
wherein an inductance of the inductor is reduced when the complex source block operates as the current source.

2. The acoustic transducer arrangement of claim 1, wherein the controller is further configured to operate as the current source in the event the value of the frequency is less than the mechanical resonance of the acoustic transducer.

3. The acoustic transducer arrangement of claim 1, wherein the controller is further configured to operate as the voltage source in the event the value of the frequency is greater than the mechanical resonance of the acoustic transducer.

4. The acoustic transducer arrangement of claim 1, wherein the impedance of the compensation block is based on an impedance of the capacitor when the complex source block operates as the voltage source.

5. The acoustic transducer arrangement of claim 1, wherein the compensation block is implemented as a Proportional-Integral-Derivative (PID) controller.

6. A method comprising:
receiving an input audio signal including a frequency;
providing a moving coil signal to a moving coil;
operating a controller as one of a current source or a voltage source to provide a stationary coil signal to a stationary coil of an acoustic transducer to induce magnetic flux within the acoustic transducer based on a value of the frequency and on a mechanical resonance of the acoustic transducer;
providing an impedance with a compensation block and a filter having a capacitor and an inductor such that a complex source block operates as the one of the current source or the voltage source; and
reducing an inductance of the inductor when the complex source block operates as the current source.

7. The method of claim 6, wherein operating the controller further includes operating the controller as the current source in the event value of the frequency is less than the mechanical resonance of the acoustic transducer.

8. The method of claim 6, wherein operating the controller further includes operating the controller as the voltage source in the event the value of the frequency is greater than the mechanical resonance of the acoustic transducer.

9. The method of claim 6, wherein the impedance of the complex source block is based on an impedance of the capacitor when the complex source block operates as the voltage source.

10. The method of claim 6, wherein the compensation block is implemented as a Proportional-Integral-Derivative (PID) controller.

11. An acoustic transducer arrangement comprising:
an audio input terminal to receive an input audio signal having a frequency;
an acoustic transducer including a stationary coil and a moving coil; and
a controller configured to:
receive the input audio signal;
provide a moving coil signal to the moving coil; and
operate as one of a current source or a voltage source to provide a stationary coil signal to the stationary coil to induce magnetic flux within the acoustic transducer based on a value of the frequency and on a mechanical resonance of the acoustic transducer,
wherein the controller includes a compensation block having a filter that includes a capacitor and an inductor to provide an impedance such that a complex source block operates as the one of the current source or the voltage source, and
wherein an inductance of the inductor is reduced when the complex source block operates as the current source.

12. The acoustic transducer arrangement of claim 11, wherein the controller is further configured to operate as the current source in the event value of the frequency is less than the mechanical resonance of the acoustic transducer.

13. The acoustic transducer arrangement of claim 11, wherein the controller is further configured to operate as the voltage source in the event the value of the frequency is greater than the mechanical resonance of the acoustic transducer.

14. The acoustic transducer arrangement of claim 11, wherein the impedance of the compensation block is based on an impedance of the capacitor when the complex source block operates as the voltage source.

15. An acoustic transducer arrangement comprising:
an audio input terminal to receive an input audio signal having a frequency;
an acoustic transducer including:
a moving diaphragm;
a magnetic material including an air gap;

a stationary coil to induce magnetic flux in the magnetic material and the air gap; and a moving coil coupled to the diaphragm and being disposed at least partially within the air gap; and a controller configured to:

receive the input audio signal;

provide a moving coil signal to the moving coil; and operate as one of a current source or a voltage source to provide a stationary coil signal to the stationary coil to induce the magnetic flux in the magnetic material based on a value of the frequency and on a mechanical resonance of the acoustic transducer, wherein the controller includes a compensation block and a filter that includes a capacitor and an inductor to provide an impedance such that a complex source block operates as the one of the current source or the voltage source, and wherein the impedance of the compensation block is based on an impedance of the capacitor when the complex source block operates as the voltage source.

16. A method comprising:

receiving an input audio signal including a frequency;

providing a moving coil signal to a moving coil;

operating a controller as one of a current source or a voltage source to provide a stationary coil signal to a stationary coil of an acoustic transducer to induce magnetic flux within the acoustic transducer based on a value of the frequency and on a mechanical resonance of the acoustic transducer; and providing an impedance with a compensation block and a filter having a capacitor and an inductor such that a complex source block operates as the one of the current source or the voltage source;

wherein the impedance of the compensation block is based on an impedance of the capacitor when the complex source block operates as the voltage source.

17. An acoustic transducer arrangement comprising:

an audio input terminal to receive an input audio signal having a frequency;

an acoustic transducer including a stationary coil and a moving coil; and a controller configured to:

receive the input audio signal;

provide a moving coil signal to the moving coil; and operate as one of a current source or a voltage source to provide a stationary coil signal to the stationary coil to induce the magnetic flux within the acoustic transducer based on a value of the frequency and on a mechanical resonance of the acoustic transducer, wherein the controller includes a compensation block having a filter that includes a capacitor and an inductor to provide an impedance such that a complex source block operates as the one of the current source or the voltage source, and wherein the impedance of the compensation block is based on an impedance of the capacitor when the complex source block operates as the voltage source.

* * * * *